US008356398B2

(12) United States Patent
McCormick et al.

(10) Patent No.: US 8,356,398 B2
(45) Date of Patent: Jan. 22, 2013

(54) MODULAR HYBRID DRILL BIT

(75) Inventors: Ron D. McCormick, Magnolia, TX (US); Rolf Carl Pessier, Galveston, TX (US); Don Q. Nguyen, Houston, TX (US); Tim King Marvel, The Woodlands, TX (US); Matthew R. Isbell, Houston, TX (US); Anton F. Zahradnik, Sugar Land, TX (US); Karlos B. Cepeda, Houston, TX (US); Michael Steven Damschen, Houston, TX (US); Steven M. Winnon, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/019,929

(22) Filed: Feb. 2, 2011

(65) Prior Publication Data

US 2011/0120269 A1 May 26, 2011

Related U.S. Application Data

(62) Division of application No. 12/114,537, filed on May 2, 2008, now abandoned.

(51) Int. Cl.
*B23P 11/00* (2006.01)
*E21B 10/00* (2006.01)

(52) U.S. Cl. ..... 29/525.02; 29/525.11; 29/525.01; 175/336; 175/366

(58) Field of Classification Search ..... 175/336, 175/364, 366; 29/525.01, 525.02, 525.11, 29/525.13, 525.14
See application file for complete search history.

(56) References Cited

U.S. PATENT DOCUMENTS

| | | | |
|---|---|---|---|
| 930,759 | A | 8/1909 | Hughes |
| 1,388,424 | A | 9/1921 | George |
| 1,394,769 | A | 10/1921 | Sorensen |
| 1,519,641 | A | 12/1924 | Thompson |
| 1,816,568 | A | 7/1931 | Carlson |

(Continued)

FOREIGN PATENT DOCUMENTS

DE 13 01 784 8/1969

(Continued)

OTHER PUBLICATIONS

Jung Hye Lee, International Search Report for International Patent Application No. PCT/US2009/042514, Korean Intellectual Property Office, dated Nov. 27, 2009.

(Continued)

*Primary Examiner* — Essama Omgba
(74) *Attorney, Agent, or Firm* — Sutton McAughan Deaver PLLC

(57) ABSTRACT

An earth-boring bit comprising a bit body is configured at its upper end for connection into a drillstring. A fixed blade depends axially downwardly from the bit body. An axially extending slot is formed in the bit body adjacent the fixed blade. A bit leg is received and retained in the slot by engagement between the slot and correspondingly shaped bit leg, wherein the bit leg cannot be removed from the slot except by axial movement relative to the bit body. A rolling cutter is secured to the bit leg at its lower extent. A fastener secures the bit leg against movement relative to the bit body and extends through oblong apertures in the bit leg and into the bit body, the bit leg can be moved axially relative to the bit body to adjust the projection of the rolling cutter relative to the fixed blade.

14 Claims, 4 Drawing Sheets

U.S. PATENT DOCUMENTS

| | | | | |
|---|---|---|---|---|
| 1,821,474 | A | | 9/1931 | Mercer |
| 1,874,066 | A | | 8/1932 | Scott et al. |
| 1,879,127 | A | | 9/1932 | Schlumpf |
| 1,896,243 | A | | 2/1933 | Macdonald |
| 1,932,487 | A | | 10/1933 | Scott |
| 2,030,722 | A | | 2/1936 | Scott |
| 2,117,481 | A | | 5/1938 | Howard et al. |
| 2,119,618 | A | | 6/1938 | Zublin |
| 2,198,849 | A | | 4/1940 | Waxler |
| 2,216,894 | A | | 10/1940 | Stancliff |
| 2,244,537 | A | | 6/1941 | Kammerer |
| 2,297,157 | A | | 9/1942 | McClinton |
| 2,320,136 | A | | 5/1943 | Kammerer |
| 2,320,137 | A | | 5/1943 | Kammerer |
| 2,380,112 | A | | 7/1945 | Kinnear |
| RE23,416 | E | | 10/1951 | Kinnear |
| 2,719,026 | A | | 9/1955 | Boice |
| 2,815,932 | A | | 12/1957 | Wolfram |
| 2,994,389 | A | | 8/1961 | Bus, Sr. |
| 3,010,708 | A | | 11/1961 | Hlinsky et al. |
| 3,050,293 | A | | 8/1962 | Hlinsky |
| 3,055,443 | A | | 9/1962 | Edwards |
| 3,066,749 | A | | 12/1962 | Hildebrandt |
| 3,126,066 | A | | 3/1964 | Williams, Jr. |
| 3,126,067 | A | | 3/1964 | Schumacher, Jr. |
| 3,174,564 | A | | 3/1965 | Morlan |
| 3,239,431 | A | | 3/1966 | Raymond |
| 3,250,337 | A | | 5/1966 | Demo |
| 3,269,469 | A | | 8/1966 | Kelly, Jr. |
| 3,387,673 | A | | 6/1968 | Thompson |
| 3,424,258 | A | | 1/1969 | Nakayama |
| 3,583,501 | A | | 6/1971 | Aalund |
| RE28,625 | E | | 11/1975 | Cunningham |
| 4,006,788 | A | | 2/1977 | Garner |
| 4,140,189 | A | | 2/1979 | Garner |
| 4,190,126 | A | | 2/1980 | Kabashima |
| 4,270,812 | A | | 6/1981 | Thomas |
| 4,285,409 | A | | 8/1981 | Allen |
| 4,293,048 | A | | 10/1981 | Kloesel, Jr. |
| 4,320,808 | A | | 3/1982 | Garrett |
| 4,343,371 | A | | 8/1982 | Baker, III et al. |
| 4,359,112 | A | | 11/1982 | Garner et al. |
| 4,369,849 | A | | 1/1983 | Parrish |
| 4,386,669 | A | | 6/1983 | Evans |
| 4,410,284 | A | | 10/1983 | Herrick |
| 4,428,687 | A | | 1/1984 | Zahradnik |
| 4,444,281 | A | | 4/1984 | Schumacher, Jr. et al. |
| 4,527,637 | A | | 7/1985 | Bodine |
| 4,572,306 | A | | 2/1986 | Dorosz |
| 4,657,091 | A | | 4/1987 | Higdon |
| 4,664,705 | A | | 5/1987 | Horton et al. |
| 4,690,228 | A | | 9/1987 | Voelz et al. |
| 4,706,765 | A | | 11/1987 | Lee et al. |
| 4,726,718 | A | | 2/1988 | Meskin et al. |
| 4,727,942 | A | | 3/1988 | Galle et al. |
| 4,738,322 | A | | 4/1988 | Hall et al. |
| 4,765,205 | A | | 8/1988 | Higdon |
| 4,874,047 | A | | 10/1989 | Hixon |
| 4,875,532 | A | | 10/1989 | Langford, Jr. |
| 4,892,159 | A | | 1/1990 | Holster |
| 4,915,181 | A | | 4/1990 | Labrosse |
| 4,932,484 | A | | 6/1990 | Warren et al. |
| 4,936,398 | A | | 6/1990 | Auty et al. |
| 4,943,488 | A | | 7/1990 | Sung et al. |
| 4,953,641 | A | | 9/1990 | Pessier |
| 4,976,324 | A | | 12/1990 | Tibbitts |
| 4,984,643 | A | | 1/1991 | Isbell et al. |
| 4,991,671 | A | | 2/1991 | Pearce et al. |
| 5,016,718 | A | | 5/1991 | Tandberg |
| 5,027,912 | A | | 7/1991 | Juergens |
| 5,028,177 | A | | 7/1991 | Meskin et al. |
| 5,030,276 | A | | 7/1991 | Sung et al. |
| 5,049,164 | A | | 9/1991 | Horton et al. |
| 5,116,568 | A | | 5/1992 | Sung et al. |
| 5,145,017 | A | * | 9/1992 | Holster et al. ..... 175/333 |
| 5,176,212 | A | | 1/1993 | Tandberg |
| 5,224,560 | A | | 7/1993 | Fernandez |
| 5,238,074 | A | | 8/1993 | Tibbitts et al. |
| 5,287,936 | A | | 2/1994 | Grimes et al. |
| 5,289,889 | A | | 3/1994 | Gearhart et al. |
| 5,337,843 | A | | 8/1994 | Torgrimsen et al. |
| 5,346,026 | A | | 9/1994 | Pessier et al. |
| 5,351,770 | A | | 10/1994 | Cawthorne et al. |
| 5,361,859 | A | | 11/1994 | Tibbitts |
| 5,429,200 | A | | 7/1995 | Blackman et al. |
| 5,439,068 | A | | 8/1995 | Huffstutler et al. |
| 5,452,771 | A | | 9/1995 | Blackman et al. |
| 5,467,836 | A | | 11/1995 | Grimes et al. |
| 5,472,057 | A | | 12/1995 | Winfree |
| 5,472,271 | A | | 12/1995 | Bowers et al. |
| 5,513,715 | A | | 5/1996 | Dysart |
| 5,518,077 | A | | 5/1996 | Blackman et al. |
| 5,547,033 | A | | 8/1996 | Campos, Jr. |
| 5,553,681 | A | | 9/1996 | Huffstutler et al. |
| 5,558,170 | A | | 9/1996 | Thigpen et al. |
| 5,560,440 | A | | 10/1996 | Tibbitts |
| 5,570,750 | A | | 11/1996 | Williams |
| 5,593,231 | A | | 1/1997 | Ippolito |
| 5,606,895 | A | | 3/1997 | Huffstutler |
| 5,624,002 | A | | 4/1997 | Huffstutler |
| 5,641,029 | A | | 6/1997 | Beaton et al. |
| 5,644,956 | A | | 7/1997 | Blackman et al. |
| 5,655,612 | A | | 8/1997 | Grimes et al. |
| D384,084 | S | | 9/1997 | Huffstutler et al. |
| 5,695,018 | A | | 12/1997 | Pessier et al. |
| 5,695,019 | A | | 12/1997 | Shamburger, Jr. |
| 5,755,297 | A | | 5/1998 | Young et al. |
| 5,862,871 | A | | 1/1999 | Curlett |
| 5,868,502 | A | | 2/1999 | Cariveau et al. |
| 5,873,422 | A | | 2/1999 | Hansen et al. |
| 5,941,322 | A | | 8/1999 | Stephenson et al. |
| 5,944,125 | A | | 8/1999 | Byrd |
| 5,967,246 | A | | 10/1999 | Caraway et al. |
| 5,979,576 | A | | 11/1999 | Hansen et al. |
| 5,988,303 | A | | 11/1999 | Arfele |
| 5,992,542 | A | | 11/1999 | Rives |
| 5,996,713 | A | | 12/1999 | Pessier et al. |
| 6,092,613 | A | | 7/2000 | Caraway et al. |
| 6,095,265 | A | | 8/2000 | Alsup |
| 6,109,375 | A | | 8/2000 | Tso |
| 6,116,357 | A | | 9/2000 | Wagoner et al. |
| 6,173,797 | B1 | | 1/2001 | Dykstra et al. |
| 6,220,374 | B1 | | 4/2001 | Crawford |
| 6,241,034 | B1 | | 6/2001 | Steinke et al. |
| 6,241,036 | B1 | | 6/2001 | Lovato et al. |
| 6,250,407 | B1 | | 6/2001 | Karlsson |
| 6,260,635 | B1 | | 7/2001 | Crawford |
| 6,279,671 | B1 | | 8/2001 | Panigrahi et al. |
| 6,283,233 | B1 | | 9/2001 | Lamine et al. |
| 6,296,069 | B1 | | 10/2001 | Lamine et al. |
| RE37,450 | E | | 11/2001 | Deken et al. |
| 6,345,673 | B1 | | 2/2002 | Siracki |
| 6,360,831 | B1 | | 3/2002 | Akesson et al. |
| 6,367,568 | B2 | | 4/2002 | Steinke et al. |
| 6,386,302 | B1 | | 5/2002 | Beaton |
| 6,401,844 | B1 | | 6/2002 | Doster et al. |
| 6,405,811 | B1 | | 6/2002 | Borchardt |
| 6,408,958 | B1 | | 6/2002 | Isbell et al. |
| 6,415,687 | B2 | | 7/2002 | Saxman |
| 6,439,326 | B1 | | 8/2002 | Huang et al. |
| 6,446,739 | B1 | | 9/2002 | Richman et al. |
| 6,450,270 | B1 | | 9/2002 | Saxton |
| 6,460,635 | B1 | | 10/2002 | Kalsi et al. |
| 6,474,424 | B1 | | 11/2002 | Saxman |
| 6,510,906 | B1 | | 1/2003 | Richert et al. |
| 6,510,909 | B2 | | 1/2003 | Portwood et al. |
| 6,527,066 | B1 | | 3/2003 | Rives |
| 6,533,051 | B1 | | 3/2003 | Singh et al. |
| 6,544,308 | B2 | | 4/2003 | Griffin et al. |
| 6,562,462 | B2 | | 5/2003 | Griffin et al. |
| 6,568,490 | B1 | | 5/2003 | Tso et al. |
| 6,581,700 | B2 | | 6/2003 | Curlett et al. |
| 6,585,064 | B2 | | 7/2003 | Griffin et al. |
| 6,589,640 | B2 | | 7/2003 | Griffin et al. |
| 6,592,985 | B2 | | 7/2003 | Griffin et al. |
| 6,601,661 | B2 | | 8/2003 | Baker et al. |
| 6,601,662 | B2 | | 8/2003 | Matthias et al. |

| | | | | |
|---|---|---|---|---|
| 6,684,967 | B2 | 2/2004 | Mensa-Wilmot et al. | |
| 6,729,418 | B2 | 5/2004 | Slaughter, Jr. et al. | |
| 6,739,214 | B2 | 5/2004 | Griffin et al. | |
| 6,742,607 | B2 | 6/2004 | Beaton | |
| 6,745,858 | B1 | 6/2004 | Estes | |
| 6,749,033 | B2 | 6/2004 | Griffin et al. | |
| 6,797,326 | B2 | 9/2004 | Griffin et al. | |
| 6,823,951 | B2 | 11/2004 | Yong et al. | |
| 6,843,333 | B2 | 1/2005 | Richert et al. | |
| 6,861,098 | B2 | 3/2005 | Griffin et al. | |
| 6,861,137 | B2 | 3/2005 | Griffin et al. | |
| 6,878,447 | B2 | 4/2005 | Griffin et al. | |
| 6,883,623 | B2 | 4/2005 | McCormick et al. | |
| 6,902,014 | B1 * | 6/2005 | Estes | 175/266 |
| 6,986,395 | B2 | 1/2006 | Chen | |
| 6,988,569 | B2 | 1/2006 | Lockstedt et al. | |
| 7,096,978 | B2 | 8/2006 | Dykstra et al. | |
| 7,111,694 | B2 | 9/2006 | Beaton | |
| 7,137,460 | B2 | 11/2006 | Slaughter, Jr. et al. | |
| 7,152,702 | B1 | 12/2006 | Bhome et al. | |
| 7,197,806 | B2 * | 4/2007 | Boudreaux et al. | 29/434 |
| 7,198,119 | B1 | 4/2007 | Hall et al. | |
| 7,234,550 | B2 | 6/2007 | Azar et al. | |
| 7,270,196 | B2 | 9/2007 | Hall | |
| 7,281,592 | B2 | 10/2007 | Runia et al. | |
| 7,320,375 | B2 | 1/2008 | Singh | |
| 7,350,568 | B2 | 4/2008 | Mandal et al. | |
| 7,350,601 | B2 | 4/2008 | Belnap et al. | |
| 7,360,612 | B2 | 4/2008 | Chen et al. | |
| 7,377,341 | B2 | 5/2008 | Middlemiss et al. | |
| 7,387,177 | B2 | 6/2008 | Zahradnik et al. | |
| 7,392,862 | B2 | 7/2008 | Zahradnik et al. | |
| 7,398,837 | B2 | 7/2008 | Hall et al. | |
| 7,416,036 | B2 | 8/2008 | Forstner et al. | |
| 7,435,478 | B2 | 10/2008 | Keshavan | |
| 7,462,003 | B2 | 12/2008 | Middlemiss | |
| 7,473,287 | B2 | 1/2009 | Belnap et al. | |
| 7,493,973 | B2 | 2/2009 | Keshavan et al. | |
| 7,517,589 | B2 | 4/2009 | Eyre | |
| 7,533,740 | B2 | 5/2009 | Zhang et al. | |
| 7,568,534 | B2 | 8/2009 | Griffin et al. | |
| 7,621,346 | B1 | 11/2009 | Trinh et al. | |
| 7,621,348 | B2 | 11/2009 | Hoffmaster et al. | |
| 7,703,556 | B2 | 4/2010 | Smith et al. | |
| 7,703,557 | B2 | 4/2010 | Durairajan et al. | |
| 7,819,208 | B2 * | 10/2010 | Pessier et al. | 175/336 |
| 7,836,975 | B2 | 11/2010 | Chen et al. | |
| 7,845,435 | B2 * | 12/2010 | Zahradnik et al. | 175/336 |
| 7,845,437 | B2 | 12/2010 | Bielawa et al. | |
| 7,847,437 | B2 | 12/2010 | Chakrabarti et al. | |
| 8,201,646 | B2 * | 6/2012 | Vezirian | 175/340 |
| 2002/0092684 | A1 | 7/2002 | Singh et al. | |
| 2002/0108785 | A1 | 8/2002 | Slaughter, Jr. et al. | |
| 2004/0099448 | A1 | 5/2004 | Fielder et al. | |
| 2004/0238224 | A1 | 12/2004 | Runia | |
| 2005/0087370 | A1 | 4/2005 | Ledgerwood, III et al. | |
| 2005/0103533 | A1 | 5/2005 | Sherwood, Jr. et al. | |
| 2005/0178587 | A1 | 8/2005 | Witman, IV et al. | |
| 2005/0183892 | A1 | 8/2005 | Oldham et al. | |
| 2005/0263328 | A1 | 12/2005 | Middlemiss | |
| 2005/0273301 | A1 | 12/2005 | Huang | |
| 2006/0032674 | A1 | 2/2006 | Chen et al. | |
| 2006/0032677 | A1 | 2/2006 | Azar et al. | |
| 2006/0162969 | A1 | 7/2006 | Belnap et al. | |
| 2006/0196699 | A1 | 9/2006 | Estes et al. | |
| 2006/0254830 | A1 | 11/2006 | Radtke | |
| 2006/0266558 | A1 | 11/2006 | Middlemiss et al. | |
| 2006/0266559 | A1 | 11/2006 | Keshavan et al. | |
| 2006/0278442 | A1 | 12/2006 | Kristensen | |
| 2006/0283640 | A1 | 12/2006 | Estes et al. | |
| 2007/0029114 | A1 | 2/2007 | Middlemiss | |
| 2007/0062736 | A1 | 3/2007 | Cariveau et al. | |
| 2007/0079994 | A1 | 4/2007 | Middlemiss | |
| 2007/0187155 | A1 | 8/2007 | Middlemiss | |
| 2007/0221417 | A1 | 9/2007 | Hall et al. | |
| 2008/0066970 | A1 | 3/2008 | Zahradnik et al. | |
| 2008/0264695 | A1 | 10/2008 | Zahradnik et al. | |
| 2008/0296068 | A1 | 12/2008 | Zahradnik et al. | |
| 2009/0114454 | A1 | 5/2009 | Belnap et al. | |
| 2009/0120693 | A1 * | 5/2009 | McClain et al. | 175/413 |
| 2009/0126998 | A1 * | 5/2009 | Zahradnik et al. | 175/57 |
| 2009/0159338 | A1 | 6/2009 | Buske | |
| 2009/0159341 | A1 | 6/2009 | Pessier et al. | |
| 2009/0166093 | A1 | 7/2009 | Pessier et al. | |
| 2009/0178855 | A1 | 7/2009 | Zhang et al. | |
| 2009/0183925 | A1 | 7/2009 | Zhang et al. | |
| 2009/0272582 | A1 * | 11/2009 | McCormick et al. | 175/336 |
| 2010/0155146 | A1 * | 6/2010 | Nguyen et al. | 175/336 |
| 2010/0224417 | A1 * | 9/2010 | Zahradnik et al. | 175/336 |
| 2010/0276205 | A1 * | 11/2010 | Oxford et al. | 175/336 |
| 2010/0288561 | A1 * | 11/2010 | Zahradnik et al. | 175/336 |
| 2010/0320001 | A1 * | 12/2010 | Kulkarni | 175/336 |
| 2011/0024197 | A1 | 2/2011 | Centala et al. | |
| 2011/0079440 | A1 * | 4/2011 | Buske et al. | 175/335 |
| 2011/0079441 | A1 * | 4/2011 | Buske et al. | 175/336 |
| 2011/0079442 | A1 * | 4/2011 | Buske et al. | 175/336 |
| 2011/0079443 | A1 * | 4/2011 | Buske et al. | 175/336 |
| 2011/0162893 | A1 | 7/2011 | Zhang | |
| 2012/0111638 | A1 * | 5/2012 | Nguyen et al. | 175/336 |

FOREIGN PATENT DOCUMENTS

| | | |
|---|---|---|
| EP | 0225101 | 6/1987 |
| EP | 0157278 | 11/1989 |
| EP | 0391683 | 1/1996 |
| EP | 0874128 | 10/1998 |
| EP | 2089187 | 8/2009 |
| GB | 2183694 | 6/1987 |
| JP | 2001159289 | 6/2001 |
| SU | 1 331 988 | 8/1987 |
| WO | 8502223 | 5/1985 |
| WO | 2008124572 | 10/2008 |
| WO | WO 2009064969 A1 * | 5/2009 |

OTHER PUBLICATIONS

Jung Hye Lee, Written Opinion for International Patent Application No. PCT/US2009/042514, Korean Intellectual Property Office, dated Nov. 27, 2009.

Pessier, R. and Damschen, M., "Hybrid Bits Offer Distinct Advantages in Selected Roller Cone and PDC Bit Applications," IADC/SPE Drilling Conference and Exhibition, Feb. 2-4, 2010, New Orleans.

Sung Joon Lee, International Search Report for International Patent Application No. PCT/US2009/050672, Korean Intellectual Property Office, dated Mar. 3, 2010.

Sung Joon Lee, Written Opinion for International Patent Application No. PCT/US2009/050672, Korean Intellectual Property Office, dated Mar. 3, 2010.

S.H. Kim, International Search Report for International Patent Application No. PCT/US2009/067969, Korean Intellectual Property Office, dated May 25, 2010.

S.H. Kim, Written Opinion for International Patent Application No. PCT/US2009/067969, Korean Intellectual Property Office, dated May 25, 2010.

Beijer, G., International Preliminary Report on Patentability for International Patent Application No. PCT/US2009/042514, The International Bureau of WIPO, dated Nov. 2, 2010.

Adri Schouten, International Search Report for International Patent Application No. PCT/US2008/083532, European Patent Office, dated Feb. 25, 2009.

Adri Schouten, Written Opinion for International Patent Application No. PCT/US2008/083532, European Patent Office, dated Feb. 25, 2009.

Sheppard, N. and Dolly, B. "Rock Drilling—Hybrid Bit Success for Syndax3 Pins." Industrial Diamond Review, Jun. 1993, pp. 309-311.

Tomlinson, P. and Clark, I. "Rock Drilling—Syndax3 Pins—New Concepts in PCD Drilling." Industrial Diamond Review, Mar. 1992, pp. 109-114.

Williams, J. and Thompson, A. "An Analysis of the Performance of PDC Hybrid Drill Bits." SPE/IADC 16117, SPE/IADC Drilling Conference, Mar. 1987, pp. 585-594.

Warren, T. and Sinor L. "PDC Bits: What's Needed to Meet Tomorrow's Challenge." SPE 27978, University of Tulsa Centennial Petroleum Engineering Symposium, Aug. 1994, pp. 207-214.
Smith Services. "Hole Opener—Model 6980 Hole Opener." [retrieved from the Internet on May 7, 2008 using <URL: http://www.siismithservices.com/b_products/product_page.asp?ID=589>].
Mills Machine Company, Inc. "Rotary Hole Openers—Section 8." [retrieved from the Internet on Apr. 27, 2009 using <URL: http://www.millsmachine.com/pages/home_page/mills_catalog/cat_holeopen/cat_holeopen.pdf>].
Georgescu, M., International Search Report for International Patent Application No. PCT/US2010/051019, dated Jun. 6, 2011, European Patent Office.
Georgescu, M., Written Opinion for International Patent Application No. PCT/US2010/051019, dated Jun. 6, 2011, European Patent Office.
Georgescu, M., International Search Report for International Patent Application No. PCT/US2010/051020, dated Jun. 1, 2011, European Patent Office.
Georgescu, M., Written Opinion for International Patent Application No. PCT/US2010/051020, dated Jun. 1, 2011, European Patent Office.
Georgescu, M., International Search Report for International Patent Application No. PCT/US2010/051017, dated Jun. 8, 2011, European Patent Office.
Georgescu, M., Written Opinion for International Patent Application No. PCT/US2010/051017, dated Jun. 8, 2011, European Patent Office.
Georgescu, M., International Search Report for International Patent Application No. PCT/US2010/051014, dated Jun. 9, 2011, European Patent Office.
Georgescu, M., Written Opinion for International Patent Application No. PCT/US2010/051014, dated Jun. 9, 2011, European Patent Office.
Georgescu, M., International Search Report for International Patent Application No. PCT/US2010/050631, dated Jun. 10, 2011, European Patent Office.
Georgescu, M., Written Opinion for International Patent Application No. PCT/US2010/050631, dated Jun. 10, 2011, European Patent Office.
Becamel, P., International Preliminary Report on Patentability, dated Jan. 5, 2012, The International Bureau of WIPO, Switzerland.

* cited by examiner

MODULAR HYBRID DRILL BIT

CROSS REFERENCE TO RELATED APPLICATIONS

The present application is a divisional application of, and claims priority benefit of, U.S. application Ser. No. 12/114,537, filed May 2, 2008 and entitled "MODULAR HYBRID DRILL BIT", now abandoned, which is incorporated herein by specific reference.

BACKGROUND OF THE INVENTION

1. Technical Field

The present invention relates in general to earth-boring drill bits and, in particular, to a bit having a combination of rolling and fixed cutters and cutting elements and a method of drilling with same.

2. Description of the Related Art

The success of rotary drilling enabled the discovery of deep oil and gas reservoirs and production of enormous quantities of oil. The rotary rock bit was an important invention that made the success of rotary drilling possible. Only soft earthen formations could be penetrated commercially with the earlier drag bit and cable tool, but the two-cone rock bit, invented by Howard R. Hughes, U.S. Pat. No. 930,759, drilled the caprock at the Spindletop field, near Beaumont, Tex. with relative ease. That venerable invention, within the first decade of the last century, could drill a scant fraction of the depth and speed of the modern rotary rock bit. The original Hughes bit drilled for hours, the modern bit drills for days. Modern bits sometimes drill for thousands of feet instead of merely a few feet. Many advances have contributed to the impressive improvements in rotary rock bits.

In drilling boreholes in earthen formations using rolling-cone or rolling-cutter bits, rock bits having one, two, or three rolling cutters rotatably mounted thereon are employed. The bit is secured to the lower end of a drillstring that is rotated from the surface or by a downhole motor or turbine. The cutters mounted on the bit roll and slide upon the bottom of the borehole as the drillstring is rotated, thereby engaging and disintegrating the formation material to be removed. The rolling cutters are provided with cutting elements or teeth that are forced to penetrate and gouge the bottom of the borehole by weight from the drillstring. The cuttings from the bottom and sides of the borehole are washed away by drilling fluid that is pumped down from the surface through the hollow, rotating drillstring, and are carried in suspension in the drilling fluid to the surface.

Rolling-cutter bits dominated petroleum drilling for the greater part of the $20^{th}$ century. With improvements in synthetic or manmade diamond technology that occurred in the 1970s and 1980s, the fixed-cutter, or "drag" bit, became popular again in the latter part of the $20^{th}$ century. Modern fixed-cutter bits are often referred to as "diamond" or "PDC" (polycrystalline diamond compact) bits and are far removed from the original fixed-cutter bits of the $19^{th}$ and early $20^{th}$ centuries. Diamond or PDC bits carry cutting elements comprising polycrystalline diamond compact layers or "tables" formed on and bonded to a supporting substrate, conventionally of cemented tungsten carbide, the cutting elements being arranged in selected locations on blades or other structures on the bit body with the diamond tables facing generally in the direction of bit rotation. Diamond bits have an advantage over rolling-cutter bits in that they generally have no moving parts. The drilling mechanics and dynamics of diamond bits are different from those of rolling-cutter bits precisely because they have no moving parts. During drilling operation, diamond bits are used in a manner similar to that for rolling cutter bits, the diamond bits also being rotated against a formation being drilled under applied weight on bit to remove formation material. Engagement between the diamond cutting elements and the borehole bottom and sides shears or scrapes material from the formation, instead of using a crushing action as is employed by rolling-cutter bits. Rolling-cutter and diamond bits each have particular applications for which they are more suitable than the other; neither type of bit is likely to completely supplant the other in the foreseeable future.

In the prior art, some earth-boring bits use a combination of one or more rolling cutters and one or more fixed blades. Some of these combination-type drill bits are referred to as hybrid bits. Previous designs of hybrid bits, such as is described in U.S. Pat. No. 4,343,371 to Baker, III, have provided for the rolling cutters to do most of the formation cutting, especially in the center of the hole or bit. Other types of combination bits are known as "core bits," such as U.S. Pat. No. 4,006,788 to Garner. Core bits typically have truncated rolling cutters that do not extend to the center of the bit and are designed to remove a core sample of formation by drilling down, but around, a solid cylinder of the formation to be removed from the borehole generally intact.

Rolling-cutter bits tend to fail when the bearing or seal fails and one or more cutters stop rotating or rotating easily. Bearing failure is most often caused by loss of lubricant from the bit or damage to the bearing as a result of severe operating conditions. In some cases, the bearing failure is so catastrophic that a cutter falls off of the bearing, which can lead to costly and time-consuming fishing operations to recover the lost cutter. Typically, rolling-cutter bits cannot successfully be refurbished because of irreparable bearing damage. Diamond bits rarely have such a catastrophic failure. Instead, individual diamond cutters tend to be lost and the bit body is slowly worn away such that it is no longer within drilling specifications. Diamond bits can be refurbished by replacing lost cutters until the bit body is too worn.

Another type of hybrid bit is described in U.S. Pat. No. 5,695,019 to Shamburger, Jr., wherein the rolling cutters extend almost entirely to the center. Fixed cutter inserts 50 (FIGS. 2 and 3) are located in the dome area 2 or "crotch" of the bit to complete the removal of the drilled formation. Still another type of hybrid bit is sometimes referred to as a "hole opener," an example of which is described in U.S. Pat. No. 6,527,066. A hole opener has a fixed threaded protuberance that extends axially beyond the rolling cutters for the attachment of a pilot bit that can be a rolling cutter or fixed cutter bit. In these latter two cases the center is cut with fixed cutter elements but the fixed cutter elements do not form a continuous, uninterrupted cutting profile from the center to the perimeter of the bit.

Although each of these bits is workable for certain limited applications, an improved hybrid earth-boring bit with enhanced drilling performance would be desirable.

SUMMARY OF THE INVENTION

It is a general object of the present invention to provide an improved earth-boring bit of the hybrid variety. This and other objects are achieved by providing an earth-boring bit comprising a bit body configured at its upper end for connection into a drillstring. At least one fixed blade depends axially downwardly from the bit body. An axially extending slot is formed in the bit body adjacent the fixed blade. A bit leg is received and retained in the slot by engagement between the slot and correspondingly shaped bit leg. At least one rolling cutter is secured to the bit leg at its lower extent.

According to an illustrative embodiment of the invention, at least one fastener secures the bit leg against movement relative to the bit body and the fastener extends through oblong apertures in the bit leg and into the bit body, wherein the bit leg can be moved axially relative to the bit body to adjust the projection of the rolling cutter relative to the fixed blade.

According to an illustrative embodiment of the invention, the slot is formed by at least three sides, and at least one acute angle is formed by two adjacent sides. The slot defines a pair of generally opposed sides connected by a third side, the generally opposed sides being inclined toward one another to define a dovetail that corresponds with the shape of the bit leg.

According to an illustrative embodiment of the invention, the bit body further comprises a shank that is configured for connection into the drillstring at its upper extent and has a generally cylindrical receptacle formed in its lower extent; and a bit body portion having a generally cylindrical upper extent, the receptacle being and dimensioned to receive the upper extent of the bit body, wherein the shank and bit body portions are secured together by welding.

According to an illustrative embodiment of the invention, the earth-boring bit further comprises a nozzle removably secured in the bit body, the nozzle receptacle configured to receive a nozzle; a bearing formed integrally with the bit leg, the rolling cutter mounted for rotation on the bearing; and a lubricant compensator removably secured in the bit leg, the lubricant compensator in fluid communication with the bearing.

BRIEF DESCRIPTION OF THE DRAWINGS

So that the manner in which the features and advantages of the present invention, which will become apparent, are attained and can be understood in more detail, more particular description of embodiments of the invention as briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
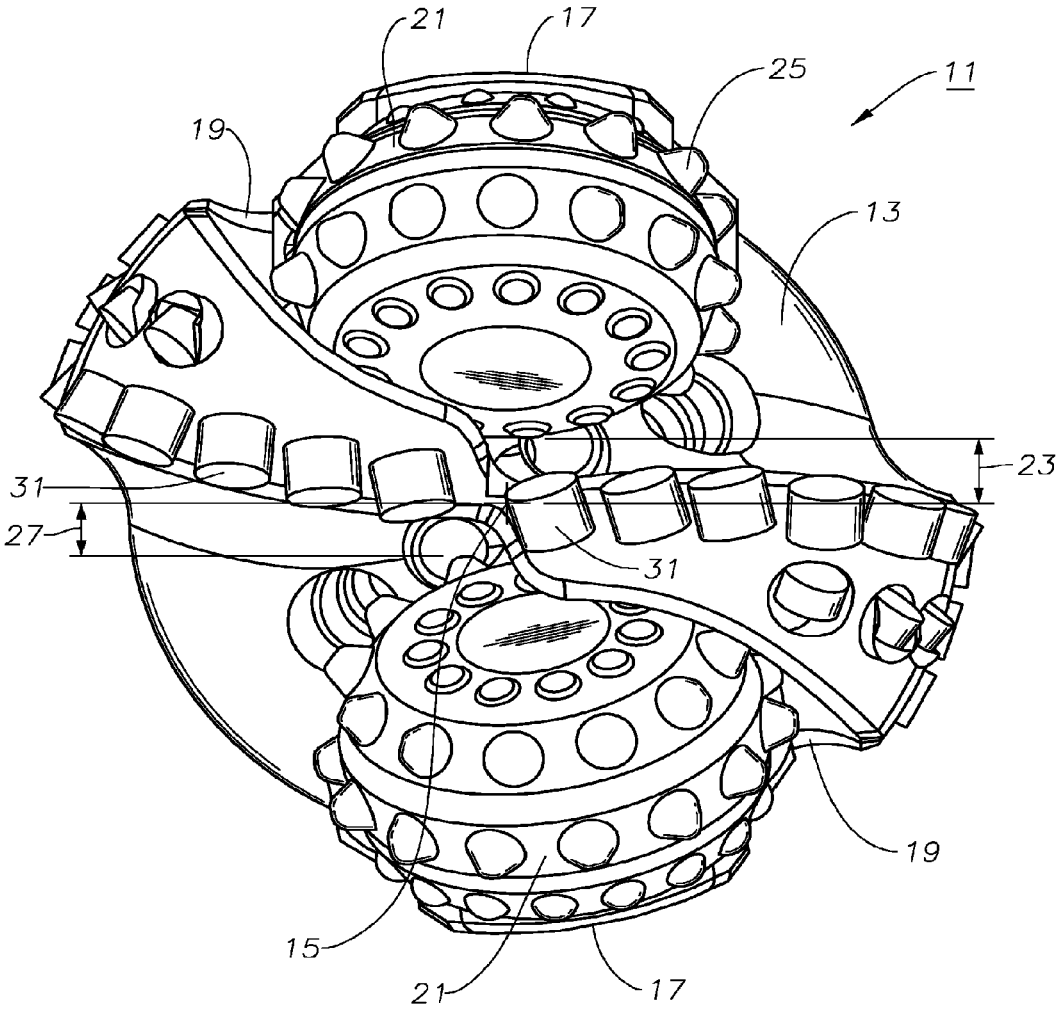
FIG. 1 is a bottom plan view of the embodiment of the hybrid earth-boring bit constructed in accordance with the present invention.
Figure 2:
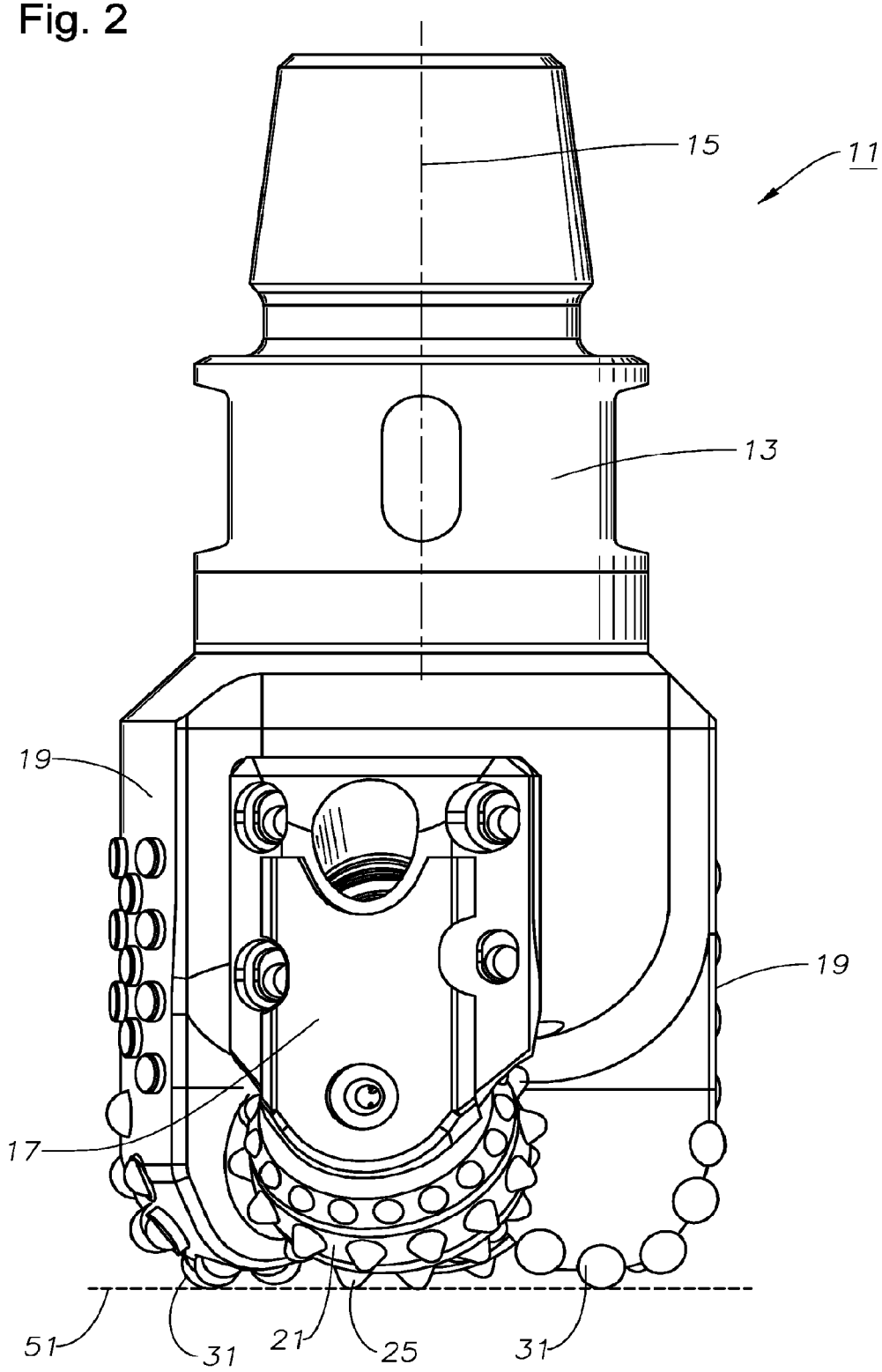
FIG. 2 is a side elevation view of an embodiment of the hybrid earth-boring bit of FIG. 1 constructed in accordance with the present invention.

Referring to FIGS. 1-2, an illustrative embodiment of a modular hybrid earth-boring drill bit is disclosed. The bit 11 comprises a bit body 13 having an axis 15 that defines an axial center of the bit body 13. A plurality (e.g., two shown) of bit legs or heads 17 extend from the bit body 13 in the axial direction. The bit body 13 also has a plurality (e.g., also two shown) of fixed blades 19 that extend in the axial direction. The number of each of legs 17 and fixed blades 19 is at least one but may be more than two (as in the case of the embodiment illustrated in FIG. 3). In one embodiment, the centers of the legs 17 and fixed blades 19 are symmetrically spaced apart from each other about the axis 15 in an alternating configuration.

Rolling cutters 21 are mounted to respective ones of the bit legs 17. Each of the rolling cutters 21 is shaped and located such that every surface of the rolling cutters 21 is radially spaced apart from the axial center 15 (FIG. 2) by a minimal radial distance 23. A plurality of rolling-cutter cutting inserts or elements 25 are mounted to the rolling cutters 21 and radially spaced apart from the axial center 15 by a minimal radial distance 27. The minimal radial distances 23, 27 may vary according to the application, and may vary from cutter to cutter, and/or cutting element to cutting element.

In addition, a plurality of fixed cutting elements 31 are mounted to the fixed blades 19. At least one of the fixed cutting elements 31 is located at the axial center 15 of the bit body 13 and adapted to cut a formation at the axial center. In one embodiment, the at least one of the fixed cutting elements 31 is within approximately 0.040 inches of the axial center. Examples of rolling-cutter cutting elements 25 and fixed cutting elements 31 include tungsten carbide inserts, cutters made of super-hard material such as polycrystalline diamond, and others known to those skilled in the art.

Figure 3:
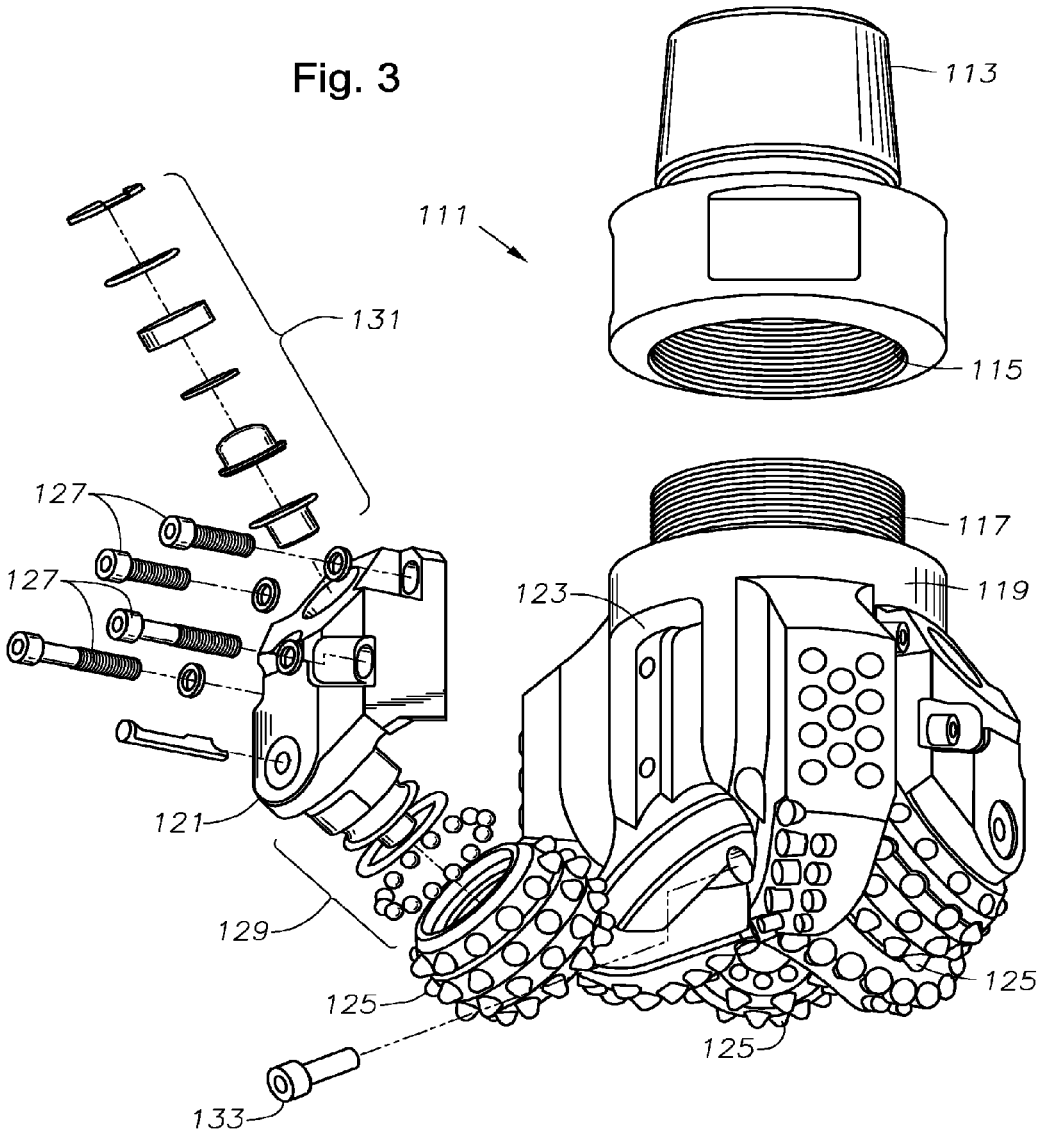
FIG. 3 is an exploded view of another embodiment of the hybrid earth-boring bit of FIG. 2 constructed in accordance with the present invention.
Figure 4:
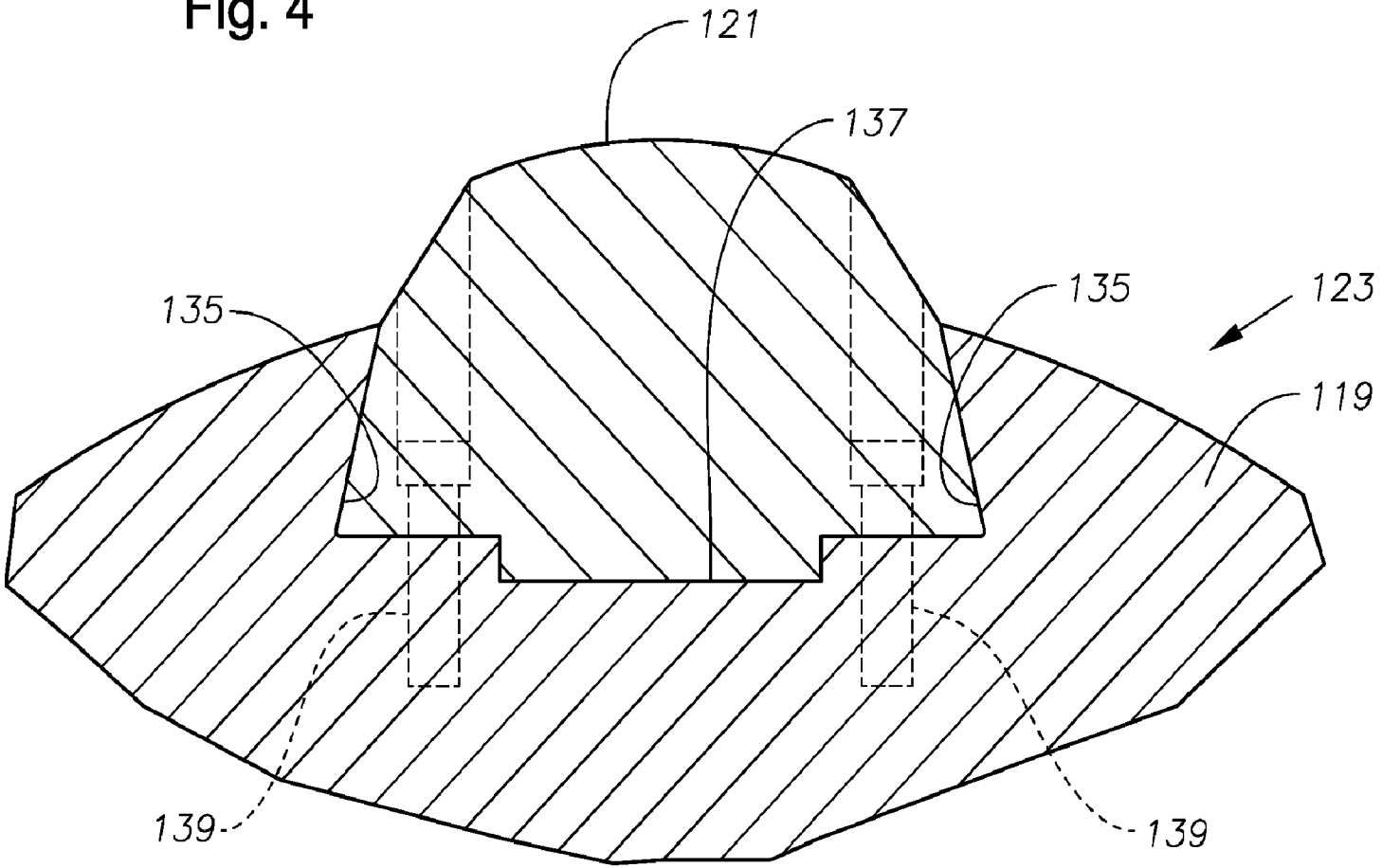
FIG. 4 is a sectional view of a portion of the earth-boring bit of FIG. 3, illustrating the configuration of the axial slot in accordance with the present invention.

FIGS. 3 and 4 illustrate the modular aspect of the bit constructed according to the present invention. FIG. 3 is an exploded view of the various parts of the bit 111 disassembled. The illustrative embodiment of FIG. 3 is a three-cutter, three-blade bit. The modular construction principles of the present invention are equally applicable to the two-cutter, two-blade bit 11 of FIGS. 1 and 2, and hybrid bits with any combination of fixed blades and rolling cutters.

As illustrated, bit 111 comprises a shank portion or section 113, which is threaded or otherwise configured at its upper extent for connection into a drillstring. At the lower extent of shank portion 113, a generally cylindrical receptacle 115 is formed. Receptacle 115 receives a correspondingly shaped and dimensioned cylindrical portion 117 at the upper extent of a bit body portion 119. Shank 113 and body 119 portions are joined together by inserting the cylindrical portion 117 at the upper extent of body portion 119 into the cylindrical receptacle 115 in the lower extent of shank 113. For the 12¼ inch bit shown, the receptacle is a Class 2 female thread that engages with a mating male thread at the upper extent of the body. The circular seam or joint is then continuously bead welded to secure the two portions or sections together. Receptacle 115 and upper extent 117 need not be cylindrical, but could be other shapes that mate together, or could be a sliding or running fit relying on the weld for strength. Alternatively, the joint could be strengthened by a close interference fit between upper extent 119 and receptacle 115. Tack welding around the seam could also be used.

A bit leg or head 121 (three are shown for the three-cutter embodiment of FIG. 3) is received in an axially extending slot 123 (again, there is a slot 123 for each leg or head 121). As shown in greater detail in FIG. 4, slot 123 is dovetailed (and leg 121 correspondingly shaped) so that only axial sliding of leg 121 is permitted and leg 121 resists radial removal from slot 123. A plurality (four) of bolts 127 and washers secure each leg 121 in slot 123 so that leg 121 is secured against axial motion in and removal from slot 123. A rolling cutter 125 is secured on a bearing associated with each leg 121 by a ball lock and seal assembly 129. The apertures in leg 121 through which bolts 127 extend are oblong, which permits the axial positioning of leg 121 within slot 123, which in turn permits selection of the relative projection of the cutting elements on each rolling cutter. A lubricant compensator assembly 131 is also carried in each leg 121 and supplies lubricant to the bearing assembly and compensates for pressure variations in the lubricant during drilling operations. A preferred compensator is disclosed in commonly assigned U.S. Pat. No. 4,727,942 to Galle and Zahradnik. At least one nozzle 133 is received and retained in the bit body portion 119 to direct a stream of drilling fluid from the interior of bit 111 to selected locations proximate the cutters and blades of the bit.

FIG. 4 is a sectional section view of bit body 119 illustrating the configuration of slot 123. As previously noted, slot 123 has a pair of adjacent opposing sides 135 that are inclined toward one another at an acute included angle (from vertical) to define a dovetail. A third side, which may be curved or flat, connects the two opposing sides 135. A rectilinear 137 recess is formed within the third side for additional engagement between the bit leg and bit body. As stated, bit leg 121 is provided with a corresponding shape so that once assembled together, bit leg 121 resists removal from slot 123 except by axial force. Preferably, for the 12¼ inch bit illustrated, slot 123 is approximately 3.880 inches wide at its widest point, opposing sides 135 are inclined at an angle of approximately 15 degrees and converge to define an included angle of approximately 30 degrees. Recess 137 is approximately 1.880 inches wide and approximately 0.385 inches deep. The corresponding surfaces of bit leg 121 are similarly dimensioned, but between 0.005 and 0.010 inch smaller to provide a sliding or running fit within the slot. A close interference fit could also be used to enhance strength, at the cost of ease of assembly. A blind threaded hole or aperture 139 is formed in bit body 119 to receive each of the fasteners or bolts 127 (FIG. 3). Alternatively, the opposed sides 135 of slot 123 could be "straight," but such a construction will not be as strong as the "dovetailed" construction and may unduly strain bolts 127.

Thus, in accordance with the present invention, the threaded shank is separable from the bit body and each bit leg and associated rolling cutter is also separable from the bit body (along with the associated lubricant compensator, bearing and seal assembly). Thus, as the bit wears, various parts may be replaced as appropriate. If the bearing associated with a cutter loses lubricant and fails, the entire bit leg assembly can be replaced as needed. If the bit body wears to the degree that it will no longer support fixed cutters (or other parts of the bit assembly), it can be replaced. If the shank is damaged, it can be replaced. Although the welded joint is not typically considered a replaceable joint, in this instance, the weld can be removed, a new shank or body portion fitted, and there will be ample material remaining to permit re-welding of the two together.

While the invention has been shown or described in only some of its forms, it should be apparent to those skilled in the art that it is not so limited, but is susceptible to various changes without departing from the scope of the invention as hereinafter claimed, and legal equivalents thereof.

We claim:

1. A method of assembling a hybrid drill bit, the method including the steps of:

providing a bit body having at least one fixed blade having a plurality of fixed cutting elements mounted thereon, and at least one slot, the blade and slot extending in the axial direction;

assembling a bit leg within the slot using one or more bolts, with each bolt passing through each of one or more oblong holes through the leg, the leg having a rolling cutter rotatably mounted thereon, the collar rolling cutter having a plurality of rolling cutter cutting elements mounted thereon;

adjusting the projection of the rolling cutter relative to the fixed blade; and thereafter tightening the bolt.

2. The method as set forth in claim 1, further including the step of assembling the bit leg within the slot using two bolts, with each bolt through each of two axially oblong holes through the leg.

3. The method as set forth in claim 2, wherein the step of adjusting the projection of the rolling cutter relative to the fixed blade comprises sliding the leg in the axial direction relative to the two bolts.

4. The method as set forth in claim 1, wherein the step of thereafter tightening the bolt includes tightening the bolt to fix the projection of the rolling cutter relative to the fixed blade.

5. The method as set forth in claim 1, wherein the projection of the rolling cutter relative to the fixed blade is fixed after the step of thereafter tightening the bolt.

6. The method as set forth in claim 1, wherein the projection of the rolling cutter relative to the fixed blade is fixed during manufacturing.

7. The method as set forth in claim 1, wherein the projection of the rolling cutter relative to the fixed blade is fixed before being employed.

8. A method of assembling a hybrid drill bit, the method including the steps of:

providing a bit body having a plurality of fixed blades, each blade having a plurality of fixed cutting elements mounted thereon, and plurality of slots, each slot including a plurality of circular threaded holes extending radially into the body, the blade and slot extending in the axial direction;

assembling a bit leg within each slot using a plurality of bolts through axially oblong holes in the leg and the circular threaded holes in the body, the leg having a rolling cutter rotatably mounted thereon, the rolling cutter having a plurality of rolling cutter cutting elements mounted thereon;

adjusting the projection of the rolling cutter relative to the fixed blade; and thereafter tightening the bolts.

9. The method as set forth in claim 8, wherein the step of adjusting the projection of the rolling cutter relative to the fixed blade comprises sliding the leg in the axial direction relative to the bolts.

10. The method as set forth in claim 8, wherein the step of thereafter tightening the bolt includes tightening the bolt to fix the projection of the rolling cutter relative to the fixed blade.

11. The method as set forth in claim 8, wherein the projection of the rolling cutter relative to the fixed blade is fixed after the step of thereafter tightening the bolt.

12. The method as set forth in claim 8, wherein the projection of the rolling cutter relative to the fixed blade is fixed during manufacturing.

13. The method as set forth in claim 8, wherein the projection of the rolling cutter relative to the fixed blade is fixed before being employed.

14. A method of assembling a hybrid drill bit, the method including the steps of:

providing a bit body having at least one fixed blade having a plurality of fixed cutting elements mounted thereon, and at least two slots, the blade and slots extending in the axial direction;

assembling a first bit leg within a first one of the slots using at least a first bolt, the first leg having a first rolling cutter rotatably mounted thereon, the first rolling cutter having a plurality of rolling cutter cutting elements mounted thereon;

assembling a second bit leg within a second one of the slots using at least a second bolt, the second leg having a second roller cutter rotatably mounted thereon, the second roller cutter having a plurality of rolling cutter cutting elements mounted thereon;

adjusting a projection of each rolling cutter relative to the fixed blade; and thereafter tightening the bolt, wherein tightening the bolt fixes the projection of each rolling cutter relative to the fixed blade, with the projection of the first rolling cutter relative to the fixed blade being independent of the projection of the second rolling cutter relative to the fixed blade.

* * * * *